US008525633B2

(12) United States Patent
Whitney et al.

(10) Patent No.: US 8,525,633 B2
(45) Date of Patent: Sep. 3, 2013

(54) FUSIBLE SUBSTRATE

(75) Inventors: Stephen J. Whitney, Lake Zurich, IL (US); William Travis, Park Ridge, IL (US); Jeffrey P. Youngblood, Crawfordsville, IN (US); Sarah M. Book, Memphis, IN (US); Edward D. Barriball, Chesterton, IN (US); Milea J. Kittle, Carmel, IN (US)

(73) Assignee: Littelfuse, Inc., Chicago, IL (US)

( * ) Notice: Subject to any disclaimer, the term of this patent is extended or adjusted under 35 U.S.C. 154(b) by 7 days.

(21) Appl. No.: 12/425,527

(22) Filed: Apr. 17, 2009

(65) Prior Publication Data

US 2010/0066477 A1 Mar. 18, 2010

Related U.S. Application Data

(60) Provisional application No. 61/046,653, filed on Apr. 21, 2008.

(51) Int. Cl.
*H01H 85/04* (2006.01)
*H01H 85/00* (2006.01)

(52) U.S. Cl.
USPC ..... 337/290; 337/297; 337/382; 337/393

(58) Field of Classification Search
USPC ..... 337/142, 290, 297, 382, 393
See application file for complete search history.

(56) References Cited

U.S. PATENT DOCUMENTS

| | | | | | |
|---|---|---|---|---|---|
| 307,639 | A | * | 11/1884 | Gilliland | 337/297 |
| 1,927,905 | A | * | 9/1933 | Slepian et al. | 337/159 |
| 2,263,752 | A | * | 11/1941 | Babler | 337/297 |
| 2,288,428 | A | * | 6/1942 | Babler | 337/29 |
| 3,358,363 | A | * | 12/1967 | Jacks et al. | 29/623 |
| 3,585,556 | A | * | 6/1971 | Hingorany et al. | 337/297 |
| 3,818,408 | A | * | 6/1974 | Andersson | 337/206 |
| 4,140,988 | A | * | 2/1979 | Oakes | 337/279 |
| 4,169,271 | A | * | 9/1979 | Saitoh | 257/529 |
| 4,296,398 | A | * | 10/1981 | McGalliard | 337/297 |
| 4,394,639 | A | * | 7/1983 | McGalliard | 337/292 |
| 4,626,818 | A | * | 12/1986 | Hilgers | 337/166 |
| 4,652,848 | A | * | 3/1987 | Hundrieser | 337/297 |
| 4,873,506 | A | * | 10/1989 | Gurevich | 337/290 |
| 4,924,203 | A | * | 5/1990 | Gurevich | 337/231 |
| 5,097,246 | A | * | 3/1992 | Cook et al. | 337/297 |
| 5,432,378 | A | * | 7/1995 | Whitney et al. | 257/529 |
| 5,453,726 | A | * | 9/1995 | Montgomery | 337/290 |
| 5,479,147 | A | * | 12/1995 | Montgomery | 337/297 |
| 5,543,774 | A | * | 8/1996 | Lof | 337/297 |
| 5,572,181 | A | * | 11/1996 | Kiryu et al. | 337/273 |
| 5,642,090 | A | * | 6/1997 | Arikawa | 337/297 |
| 5,712,610 | A | * | 1/1998 | Takeichi et al. | 337/290 |
| 5,790,008 | A | * | 8/1998 | Blecha et al. | 337/297 |
| 5,844,477 | A | * | 12/1998 | Blecha et al. | 337/297 |
| 5,914,649 | A | * | 6/1999 | Isono et al. | 337/290 |
| 5,923,239 | A | * | 7/1999 | Krueger et al. | 337/297 |
| 5,963,121 | A | * | 10/1999 | Stygar et al. | 337/155 |
| 5,982,268 | A | * | 11/1999 | Kawanishi | 337/297 |
| 5,994,993 | A | * | 11/1999 | Castonguay et al. | 337/206 |
| 6,002,322 | A | * | 12/1999 | Krueger et al. | 337/297 |
| 6,040,754 | A | * | 3/2000 | Kawanishi | 337/297 |

(Continued)

*Primary Examiner* — Anatoly Vortman

(74) *Attorney, Agent, or Firm* — Kacvinsky Daisak PLLC

(57) ABSTRACT

A fuse element includes a substrate disposed between first and second terminals. The substrate includes an electrically insulative material. A conductive film is disposed on a first surface of the substrate and in electrical contact with the first terminal and second terminals.

7 Claims, 3 Drawing Sheets

(56) References Cited

U.S. PATENT DOCUMENTS

| | | | | |
|---|---|---|---|---|
| 6,147,586 | A * | 11/2000 | Saitoh et al. | 337/297 |
| 6,384,708 | B1 * | 5/2002 | Jollenbeck et al. | 337/297 |
| 6,809,627 | B2 * | 10/2004 | Castonguay et al. | 337/243 |
| 7,477,130 | B2 * | 1/2009 | Fukushige et al. | 337/297 |
| 7,489,229 | B2 * | 2/2009 | Jollenbeck et al. | 337/297 |
| 7,489,230 | B2 * | 2/2009 | Ueda | 337/297 |
| 2003/0001716 | A1 * | 1/2003 | Kaltenborn et al. | 337/273 |
| 2005/0001710 | A1 * | 1/2005 | Mukai et al. | 337/297 |

* cited by examiner

FUSIBLE SUBSTRATE

This application claims priority to, and the benefit of, U.S. Provisional Application 61/046,653, filed Apr. 21, 2008, which is hereby incorporated by reference in its entirety.

BACKGROUND

The present disclosure relates, generally, to circuit protection devices. More particularly, it relates to fusible substrates that fracture upon reaching a predetermined temperature to provide overcurrent protection.

Existing fuses have several issues regarding both failing when they should not fail and not failing when they should fail. Severe surges such as lightning strikes should cause the fuse to fail; however, the fuse needs to withstand smaller surges such as those that occur upon initial current flow through the circuit. Brief, severe surges are not the only condition that should cause fuse failure. A phenomenon known as a sneak current can also overload a circuit resulting in fuse failure. Sneak currents occur by an incident such as a power line falling on top of a telephone line, which induces a low level increase in current that exceeds the capacity of the circuit. Present fuse technology allows for complete fuse failure within 30 seconds under a sneak current. Although this time appears to be short, circuit damage can still occur within these 30 seconds.

A phenomenon known as arcing can also be problematic in that it allows the fuse to carry current after the onset of melting. The fuse element begins to melt at its hottest spot, typically in the middle of the fuse. Metal vapor remains in the air gap between the melted ends. The metal vapor continues to conduct the current across the gap which is fed by the voltage in the circuit. The arc generates a plasma of ionized gases which then takes over the current. The ionized arc creates more heat, pressure, and current in the gap.

SUMMARY

In an embodiment, a fuse element includes a substrate disposed between first and second terminals. The substrate includes an electrically insulative material. A conductive film is disposed on a first surface of the substrate and in electrical contact with the first terminal and second terminals. In an embodiment, the substrate includes a ceramic material. In an embodiment, the film includes a metal selected from the group consisting of copper, gold, and mixtures thereof. In an embodiment, the coefficient of thermal expansion of the substrate is lower than a coefficient of thermal expansion of the coating.

In an embodiment, the substrate has a cylindrical shape. In an embodiment, the conductive film is disposed on an outer surface of the substrate. In another embodiment, the substrate has a rectangular cross section and four outer surfaces extending between the terminals. In an embodiment, the conductive film is disposed on one of the outer surfaces of the substrate.

In an embodiment, a fuse element includes a substrate disposed between first and second terminals. The substrate includes a conductive polymer material. In an embodiment, the conductive polymer material includes metal particles dispersed in a polymer matrix. In another embodiment, the conductive polymer material includes a doped polymer material.

In an embodiment, a fuse element includes a substrate disposed between first and second terminals. The substrate is composed of a material with a melting point between 300° C. and 800° C. A layer including a conductive material is disposed over the substrate. In an embodiment, the substrate is composed of a wax. In an embodiment, the substrate is capable of withstanding a temperature of 260° C. for at least 2 minutes without melting.

In an embodiment, a fuse element includes a conductive material disposed between the first terminal and the second terminal. A substrate is disposed between the conductive material and one of the first terminal and the second terminal. The substrate is composed of a material with a melting point between 300° C. and 800° C. In an embodiment, the substrate includes a first substrate, further including a second substrate disposed between the conductive material and the other of the first terminal and the second terminal. In an embodiment, the substrate is capable of withstanding a temperature of 260° C. for at least 2 minutes without melting.

Additional features and advantages are described herein, and will be apparent from the following Detailed Description and the figures.

DETAILED DESCRIPTION

The present disclosure provides a fuse element that fractures rather than melts, which reduces failure time and provides overcurrent protection.

The present disclosure provides a fuse that breaks a current quickly when operating parameters are exceeded without the potential for arcing. The fuse is particularly useful for telecommunications circuit boards. Specifically, the present disclosure provides fuse elements including an insulating substrate with a conductive coating. Unlike existing fuses, which generally rely on a melting mechanism for failure, the fuse elements disclosed herein fracture rather than melt. By eliminating the need for melting in the fuse element, the chance for arcing is reduced. By breaking a conductive material apart from an insulating substrate as an alternative to melting, a large gap between the contacts is created, raising the arcing voltage. The fuse elements disclosed herein capitalize on a mismatch in the coefficients of thermal expansion between the substrate and conductive layer.

Figure 1A:
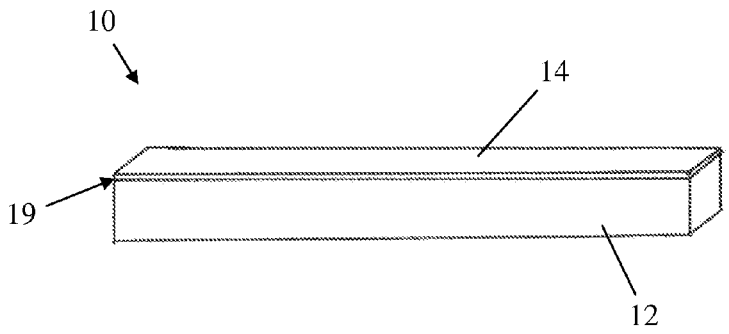
FIG. 1A is an isometric view of an embodiment of a fuse element.
Figure 1B:
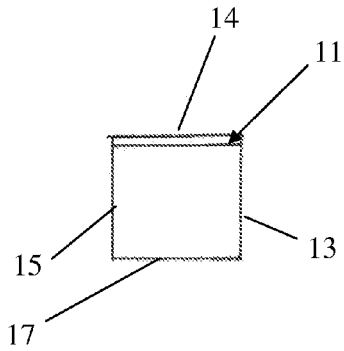
FIG. 1B is a cross-section view of the fuse element of FIG. 1A.

FIGS. 1A and 1B illustrate a fuse element 10 including a conductive coating 14 on a substrate 12. The substrate 12 is preferably constructed from a ceramic with a low coefficient of thermal expansion. The substrate 12 may be alumina or quartz. The conductive coating 14 may be applied to the substrate 12 using a deposition process or by painting a conductive slurry onto the substrate 12. The coating 14 may also be applied by deposition processing or sputter coating. A mismatch of thermal expansion coefficients between the substrate 12 and the coating 14 results in a large induced stress that causes the coating 14 to break apart from the substrate 12 at a critical current or temperature. The fuse element 10 may also include an intermediate layer (not shown) between the conductive coating 14 and the substrate 12. The intermediate layer may be a sol-gel material. Upon heating, the sol-gel layer undergoes a phase transformation resulting in a large volume change, thus enhancing the fracturing of the fuse element 10.

The induced stress may be caused by the conductive coating 14 undergoing electrical resistance heating and expanding at a different rate than the substrate 12, increasing the strain at the coating/substrate interface 19. The stress at the interface 19 is large enough at a certain critical temperature to cause the conductive coating 14 to break off from the substrate 12 in a brittle manner, stopping the current through the device 10 without much potential for arcing.

The geometry of fuse element 10 includes a flat ceramic substrate 12 with a conductive coating 14 applied to only one surface 11. The other four surfaces 13, 15, 17 are left uncoated. Another embodiment of the fuse element includes a cylindrical ceramic rod with a 360-degree conductive coating. It is believed that heat transfer from the planar design may be more efficient than a cylindrical design as there is a free, non-conducting surface. Also, a more uniform deposition of the conductive coating may be achieved in a planar geometry.

Figure 2:
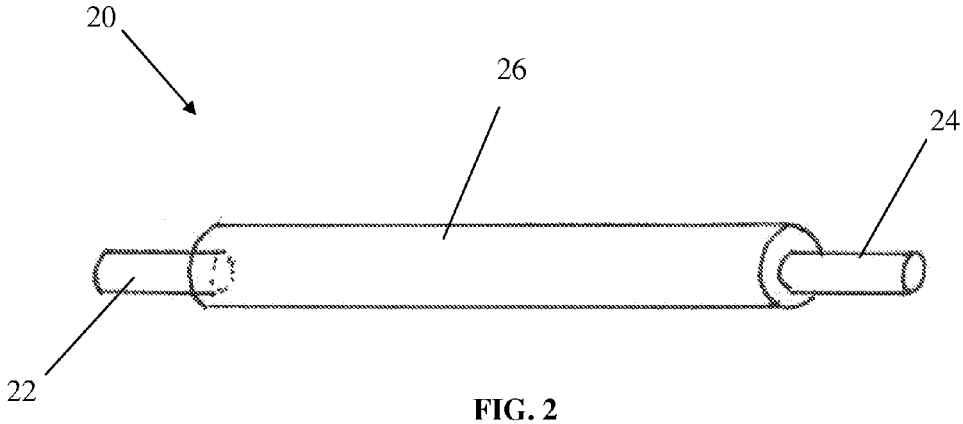
FIG. 2 is an isometric view of another embodiment of a fuse element.

FIG. 2 illustrates an embodiment of a polymer based fuse element 20. The fuse element 20 includes of a fuse body 26 and terminals 22, 24. The fuse body 26 is composed of a material such as a conductive polymer, a conductive polymer containing dispersed metal particles, or a non-conductive polymer containing dispersed metal particles. Metal particles in a polymer matrix can raise the electrical conductivity of the system. The principle of the design relies on the fuse undergoing electrical resistance heating and melting at a critical current. The fuse element 20 is formed to the desired length and diameter using an extruder. Metal particles may be mixed with the polymer during extrusion if necessary. The failure method for this fuse element would produce a quick and predictable failure at the melting temperature.

Figure 3A:
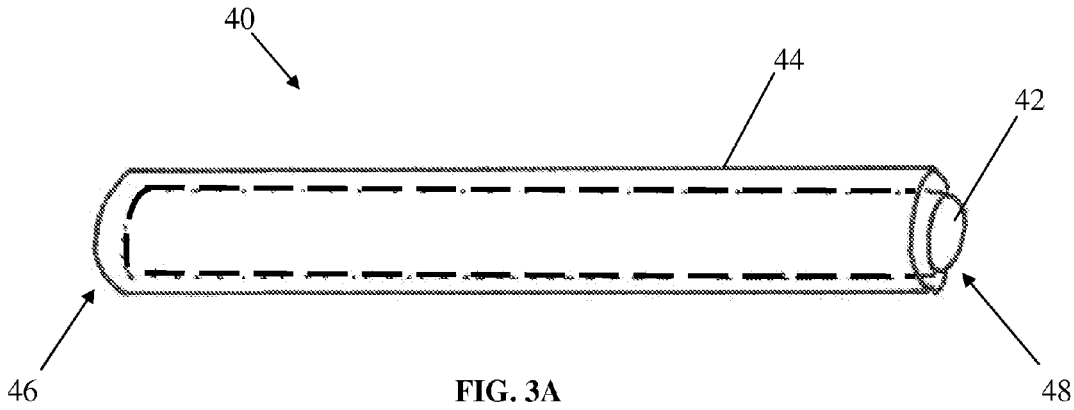
FIG. 3A is an isometric view of another embodiment of a fuse element.
Figure 3B:
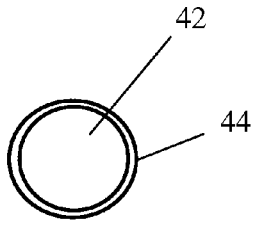
FIG. 3B is a cross-section view of the fuse element of FIG. 3A.

FIGS. 3A and 3B illustrates a fuse element 40 including terminals (not shown) disposed at either end 46, 48. The fuse element 40 includes a cylindrical substrate 42 with a conductive metal thin film coating 44. The substrate 42 melts at a fixed temperature, preferably between about 300° C. and 800° C. The substrate 42 may be composed of wax or a similar material. The wax core 42 melts upon heating, causing the conductive coating 44 to disperse, eliminating conduction between the terminals. The wax core 42 may be produced through the use of molds. Molten wax is poured into a mold of the desired shape and allowed to cure. The conductive thin film coating 44 is then applied through deposition of copper or gold. The failure method produces a predictable failure at the melting temperature of the wax core 42. The wax is preferably capable of withstanding 260° C. for 2 minutes.

Figure 4:
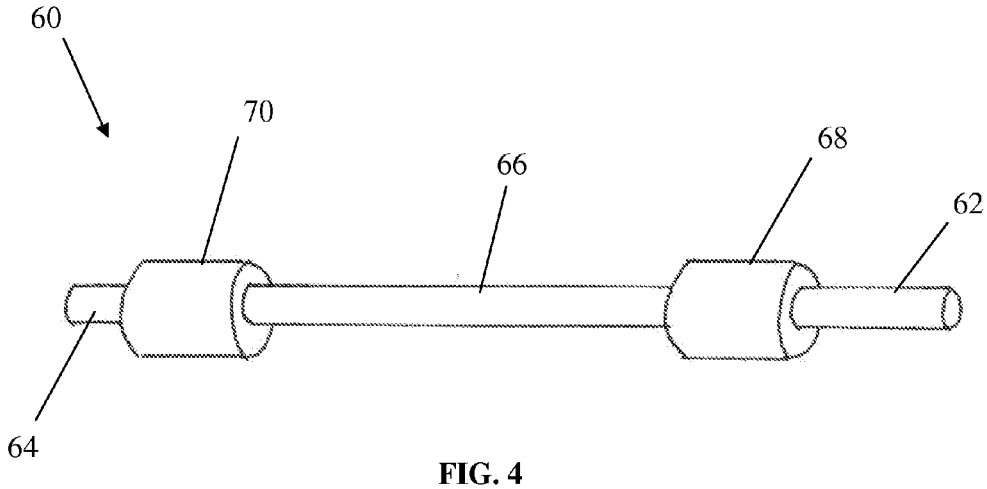
FIG. 4 is an isometric view of another embodiment of a fuse element.

FIG. 4 illustrates a fuse element 60 including a conductive material 66 disposed between terminals 62, 64. A least one substrate 68 is disposed between the conductive material 66 and one of the terminals 62, 64. The substrate 68 is composed of a conductive material with a set melting point between 300° C. and 800° C. A second substrate 70 may be disposed between the conductive material 66 and the terminal 64. The conductive material of substrate 68 melts upon the heating of the fuse element 60, thus causing the conductive material 66 (such as a copper wire) suspended between the terminals 62, 64 to fall from connection with the terminals 62, 64, eliminating current flow throughout the circuit.

Processing fuse element 60 is similar to that of the previously described extruded polymer design or the wax core design. The conductive substrates 68, 70 may be produced through the use of molds or extrusion. The substrates 68, 70 may be melted, poured into a mold of the desired shape, and allowed to cure if a wax-like material was chosen. If a conductive polymer is used, extrusion may be used to create cylinders of desired length and diameter. The conductive material 66 and terminals 62, 64 are inserted into the premolded or extruded material. The melting of the substrates 68, 70 produces a quick and accurate failure point for the fuse element 40.

Figure 5:
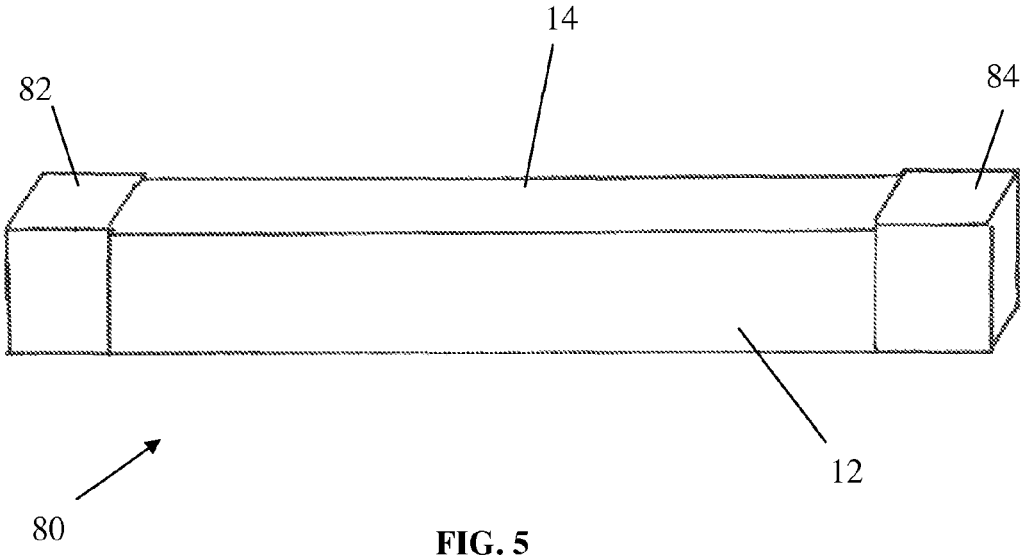
FIG. 5 is an isometric view of another embodiment of a fuse element.

As shown in FIG. 5, fuse element 80 is a variation of the fuse element 10 discussed above. Element 80 includes a substrate with restrained ends and using a ceramic with a high coefficient of thermal expansion. Constraining the ends of the substrate 12 with elements 82, 84 reduces the amount of freedom that the ceramic has to expand, resulting in large internal stresses as the temperature of the ceramic rises. At a critical stress, the ceramic substrate 12 fails catastrophically, resulting in an immediate break of the fuse element 10.

The fuse elements disclosed herein are preferably smaller than 10×1×1 mm, are able to withstand a temperature of 260° C. for 2 minutes, can conduct a current of 0.5 Ampere DC indefinitely, will fail under severe surge currents, and will fail under low level currents of 2.2 Ampere rms AC within ten seconds.

EXAMPLES

Experimental Procedure

Two experimental fuse elements were fabricated. Both fuse elements consisted of a 0.79 mm diameter, 30 mm long alumina rod painted with a Hobby Colorobbia Bright Gold slurry that, upon firing, became 22 karat gold. Paint uniformity was checked by visual inspection. The slurry was fired in a kiln at pyrometric cone 018 (about 695° C.).

After firing, both fuse elements were tested in a test apparatus. The fuse elements were connected to a circuit by inserting each element in series with the other components. The electrical current was increased from zero Amperes in increments of 0.1 A with a minute long hold at each current. Once a current of 0.5 A was reached, a five minute hold was performed. After holding at 0.5 A, current was once again increased in 0.05 A to 0.1 A increments with one minute holds until fuse failure.

Test Results

Two experimental fuse elements were fabricated by the same method, as discussed above in the experimental section. The coating thickness was approximately 10 μm. Both of these elements were tested in a test apparatus configured to subject the fuse element to a controlled current and voltage. The gold-coated alumina rod in Test 1 was placed in the circuit in series to test the conducting capabilities of the basic design idea of a thin film of gold on a ceramic substrate. The fuse element survived for one minute at 0.15 A, 0.2 A, 0.3 A, and 0.4 A at 30 V DC. The fuse element conducted an operating current of 0.5 A for five minutes. The current abruptly stopped when increased to 0.75 A, with the fuse showing no signs of melting or fracture.

A second gold-coated alumina road was used in Test 2 with the same experimental set-up. The fuse element survived for one minute at 0.15 A, 0.2 A, 0.3 A, 0.4 A and survived for five minutes at 0.5 A. The current was increased by a smaller increment in Test 2 after reaching 0.5 A. The fuse element survived for one minute at 0.6 A, 0.7 A, and 0.75 A. Within 20 seconds at 0.8 A, the color of the center of the fuse became bright orange due to an increase in temperature. The fuse element survived when held at 0.8 A for a total of five minutes. The current was increased to 0.825 A at which point the fuse element stopped conducting after 1 min 35 sec. To the naked eye, the fired coating on the failed fuse element used in Test 1 appeared to be similar in color and roughness across the length of the rod. No failure location could be identified in Test 1.

The fuse element in Test 2 was examined both by optical and scanning electron microscopy. The failure location was clearly visible as a gray ring around the circumference of the element. The gold layer appeared to have melted and due to surface tension, separated at the center and receded to expose the alumina substrate.

After analysis of the fuse elements, theories were developed regarding the failure mechanism. It is theorized that gold may diffuse rapidly into alumina. The glowing orange color of the fuse indicated the temperature was somewhere in the range of 800-1100° C.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A fuse element comprising:

a first terminal;

a second terminal;

a substrate disposed between the first and second terminals, the substrate having a rectangular cross-section with four outer surfaces extending between the first and second terminals, the substrate comprising an electrically insulative material having a first thermal expansion coefficient; and a conductive film having a second thermal expansion coefficient and disposed on only one of the four outer surfaces of the substrate defining an interface therebetween, the conductive film in electrical contact with the first terminal and second terminals, wherein the other three outer surfaces of the substrate are not coated with said conductive film, and wherein a difference in the first and second thermal expansion coefficient causes the conductive film to expand at a different rate than the substrate and impart stress at the interface forcing the conductive film to fracture and break apart from the substrate at a critical temperature to increase an arcing voltage between the first and second terminals.

2. The fuse element of claim 1 wherein the substrate comprises a ceramic material.

3. The fuse element of claim 1 wherein the film comprises a metal selected from the group consisting of copper, gold and mixtures thereof.

4. The fuse element of claim 1, wherein the first thermal expansion coefficient is lower than the second thermal expansion coefficient.

5. The fuse element of claim 1 further comprising an intermediate layer disposed between the conductive film and the substrate.

6. The fuse element of claim 1 wherein the intermediate layer is a sol-gel material.

7. The fuse element of claim 1, wherein the intermediate layer undergoes a phase transformation when an operating parameter is exceeded.

* * * * *